US006690107B1

(12) United States Patent
Van Doorn et al.

(10) Patent No.: US 6,690,107 B1
(45) Date of Patent: Feb. 10, 2004

(54) COLOR DISPLAY DEVICE HAVING COLOR FILTER LAYERS

(75) Inventors: Arie R. Van Doorn, Eindhoven (NL); Remko Horne, Eindhoven (NL); Godefridus P. Van Melis, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/080,944

(22) Filed: May 19, 1998

(30) Foreign Application Priority Data

May 26, 1997 (EP) ..... 97201591

(51) Int. Cl.[7] ..... H01J 29/28; H01J 29/10
(52) U.S. Cl. ..... 313/466; 313/474; 313/473
(58) Field of Search ..... 313/496, 466, 313/461, 463, 473, 474, 479, 112; 430/27, 29; 501/64

(56) References Cited

U.S. PATENT DOCUMENTS 2,618,759 A * 11/1952 Hoyt ..... 313/461
3,725,710 A * 4/1973 De Gier et al. ..... 313/64
4,177,399 A * 12/1979 Muccigrosso et al. ..... 313/368
4,390,637 A * 6/1983 Daiku ..... 501/64
4,757,231 A * 7/1988 Kato et al. ..... 313/461
5,177,400 A * 1/1993 Iwasaki ..... 313/466
5,543,685 A 8/1996 Okamoto et al. ..... 313/496
6,100,632 A * 8/2000 Iida ..... 313/461
6,137,459 A * 10/2000 Eida et al. ..... 313/501

FOREIGN PATENT DOCUMENTS

JP 11224616 A * 8/1999 ..... H01J/29/28

OTHER PUBLICATIONS

Lawrence E. Tannas, Jr., Flat Panel Displays and CRTs, Van Nostrand Reinhold Company ,New York , table 8.2 1985 (no month).*

* cited by examiner

*Primary Examiner*—Nimeshkumar D. Patel
*Assistant Examiner*—Karabi Guharay

(57) ABSTRACT

A transparent inorganic intermediate layer extends between a color filter layer and a phosphor layer in a color display device. The intermediate layer stops electrons before they can penetrate the color filter layer. Aging phenomena which adversely affect the effectiveness of the color filter layer are thus precluded. It is alternatively possible to use hitherto useless pigments, in particular pigments which are unstable when they are exposed to an electron bombardment in the color filter layer (or layers). By virtue thereof, the effectiveness of the color filter layer has been increased.

14 Claims, 4 Drawing Sheets

COLOR DISPLAY DEVICE HAVING COLOR FILTER LAYERS

BACKGROUND OF THE INVENTION

The invention relates to a color display device comprising a means for generating electrons and a substrate provided with a phosphor pattern, a color filter layer extending between the phosphor pattern and the substrate.

The invention also relates to a method of manufacturing a display device, in which a color filter layer and a phosphor pattern are provided on a substrate.

Color display devices of the type mentioned in the opening paragraph are used, inter alia, in television receivers and computer monitors.

A color display device of the type mentioned in the opening paragraph is known. The known color display device comprises a cathode ray tube incorporating an electron gun and a display window, the inner surface of said display window being provided with a phosphor pattern. Said phosphor pattern has sub-patterns of phosphor regions luminescing in red, green and blue (hereinafter also referred to as, respectively, "red", "green" and "blue" phosphors) and it may further comprise a so-called black matrix. A black matrix layer is a black layer having apertures or a system of black stripes on the substrate and (partly) between the phosphor regions from which the phosphor pattern is built up, and said black matrix layer improves the contrast of the image displayed. The black matrix is provided with apertures accommodating colored layers (also referred to as color filter layers) on which a phosphor region of a corresponding color is deposited. The color filter layers may also extend over the black matrix. The color filter layer absorbs incident light of other wavelengths than the light emitted by the relevant phosphor. This leads to a reduction of the diffuse reflection of the incident light and improves the contrast of the image displayed. In addition, the color filter layer (for example a "red" layer) may absorb a part of the radiation emitted by the "red" phosphor, namely the part whose wavelengths are situated outside the red portion of the visible spectrum. This results in an improvement of the color point of the red phosphor. The known color display device comprises a color filter layer for each of the phosphors (red, green and blue). For clarity, it is noted that "red", "blue" and "green" color filter regions have a relatively high transmission for red, blue and green light, respectively. The color indication of the color filter layers relates to the transmission properties of the filters, not to their color.

However, the effectiveness of the color filters in the known color display device is insufficient. The better the absorption spectrum is attuned to the light emitted, the greater the effectiveness of the color filter and the better the image display.

OBJECTS AND SUMMARY OF THE INVENTION

It is an object of the invention to provide a color display device of the type mentioned in the opening paragraph, which enables a better image display to be achieved.

To achieve this, a color display device of the type mentioned in the opening paragraph is characterized in that a transparent intermediate layer extends between the color filter layer and the phosphor pattern.

The invention is based on the recognition that the color filter layer and the phosphor pattern are excited by means of relatively high-energy electrons (approximately 25 kVolts of kinetic energy). A part of the electrons pass through the phosphor pattern, however, their kinetic energy level generally undergoes a reduction. Electrons which are passed by the phosphor pattern and reach the color filter layer may adversely affect the quality of the color filter layer in the course of time, so that the materials to be used for the color filter layer are subject to limitations. The electrons cause an ageing phenomenon in the color filter layer. As a result of said ageing phenomenon, the absorption spectrum of the color filter layer is subject to change. This adversely affects the quality of the image displayed. The provision of an intermediate layer causes the electrons to be stopped, at least in part, by said intermediate layer, so that fewer electrons reach the color filter layer. The intermediate layer is chosen to be transparent so that the intermediate layer passes light emitted by the phosphor pattern. Preferably, the intermediate layer comprises inorganic materials. In comparison with organic materials, inorganic materials exhibit a better resistance to electron bombardment and, at the same layer thickness, the number of electrons that is stopped is far greater. In embodiments of the invention, the materials used for the color filter are not stable when they are exposed to an electron bombardment with electrons having a kinetic energy above 7.5 kVolts, said materials being mainly organic pigments, such as (codification in accordance with Color Index) PR190, PR123, PR149, PR178, PR202, PR206, PV29, PB16, PB27 and ZnPc, Red 4013TR (manufactured by Ciba-Geigy). Preferably, the intermediate layer has a layer thickness d (in nm) which exceeds $25(A/rho)(E_0/Z^{0.5})^n$, wherein A is the molecular weight, rho is the density (in $gr/cm^3$), Z is the atomic number and n is given by $n=1.2/(1-0.29 \log_{10}Z)$ and $E_0$ is 7.5 (kVolts). Intermediate layers of such a thickness stop almost all electrons. The layer thickness preferably does not exceed 2 times the thickness indicated above by means of the formula. Layers having a larger thickness do not offer more protection. In comparison with organic materials, inorganic materials generally have a higher Z number and a higher density rho and are hence preferred to organic materials.

As a result, the invention enables a much greater variety of color filters to be used, so that the absorption spectrum of the phosphor and the color filter can be better attuned to each other. The color filter layers used hitherto, such as layers based on iron oxide (red color filters), cobalt aluminate (blue color filters) and $CoO.NiO.TiO_2.ZnO$ (green color filters) are by no means perfect. When use is made of the known color filter layers, the increase of the so-called LCP value (Luminance Contrast Performance, defined by the white Luminance ($L_w$) divided by the diffuse Reflection $R^{1/2}_{diff}$ ($LCP=Lw/R^{1/2}_{diff}$)) amounts to only 20% of the increase achieved with a comparable color display device without color filter layers. By replacing iron oxide with, for example, Red 4013TR or cobalt aluminate with, for example, PB27, the increase of the LCP-value amounts to approximately 28%.

Preferably, the specific mass of the material of the inorganic layer is above 3 $g/cm^3$. The higher the specific mass, the better the electrons are stopped. If the specific mass exceeds 3.0 $g/cm^3$, the intermediate layer exhibits a considerable stopping effect, even if it is less than 1 micrometer thick. Sub-micron layers (layers having a thickness below 1 micrometer) can be applied more readily and exhibit fewer disadvantages.

A method of the type mentioned in the second paragraph is characterized in accordance with the invention in that an intermediate layer is provided between the color filter layer and the phosphor pattern.

In addition to the above-mentioned advantages, the method has the advantage that a reduction of phosphor haze is achieved. Phosphor haze occurs if phosphor particles of a specific color (for example red) adhere to regions which are intended for phosphor particles of another color, for example blue. This is an undesirable phenomenon which causes color impurities and hence a reduction of the quality of the image displayed. The provision of an intermediate layer between the color filter regions and the phosphor pattern reduces phosphor haze and hence improves the quality of the image displayed.

These and other aspects of the invention will be apparent from and elucidated with reference to the embodiments described hereinafter.

BRIEF DESCRIPTION OF THE PREFERRED EMBODIMENTS

The Figures are not drawn to scale. In the Figures, like reference numerals generally refer to like parts.

DESCRIPTION OF THE PREFERRED EMBODIMENTS

Figure 1:
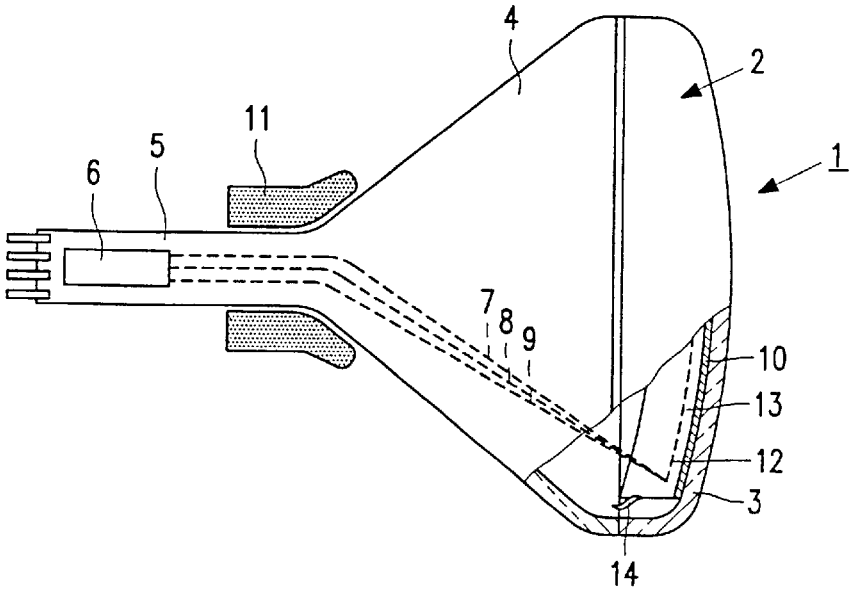
FIG. 1 is a cross-sectional view of a display tube.

A color display tube 1 (FIG. 1) has an evacuated envelope 2 which comprises a display window 3, a cone portion 4 and a neck 5. An electron gun 6 for generating three electron beams 7, 8 and 9 is arranged in said neck 5. A display screen 10 is situated on the inside of the display window. Said display screen 10 has a phosphor pattern of phosphor elements luminescing in red, green and blue. On their way to the display screen 10, the electron beams 7, 8 and 9 are deflected across the display screen 10 by means of a deflection unit 11 and pass through a shadow mask 12 which is arranged in front of the display window 3 and which comprises a thin plate having apertures. The shadow mask is suspended in the display window by means of suspension means 14. The three electron beams 7, 8 and 9 pass through the apertures 13 of the shadow mask at a small angle relative to each other and hence each electron beam impinges on phosphor elements of only one color.

Figure 2A:
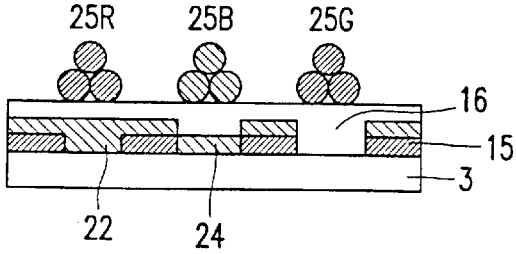
FIGS. 2A and 2B are cross-sectional views of a display window for a display device in accordance with the invention.
Figure 2B:
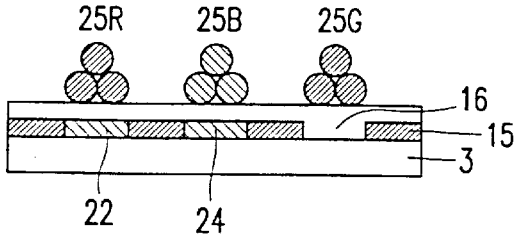

FIGS. 2A and 2B are cross-sectional views of two color display devices in accordance with a first aspect of the invention. The substrate 3 is provided with a red color filter layer 22 which, in FIG. 2A, also covers the black matrix, and, in FIG. 2B, only extends in apertures in the black matrix, as well as with a blue color filter layer 24 and a black matrix 15. A preferably inorganic intermediate layer 16 is situated between the color filter layers and the phosphors 25R (red luminescent phosphor), 25B (blue luminescent phosphor) and 25G (green luminescent phosphor). The thickness of this intermediate layer is such that at least a substantial part of the electrons passed by the phosphors are stopped. The inventors have found that the average kinetic energy of electrons passed by the phosphor layer is of the order of 7.5 keV. The following Table gives the penetration depth (the thickness at which practically all electrons are stopped by a layer) for a number of inorganic materials. The penetration depth can be calculated from:

$$\text{penetration depth}=25(A/rho)(E_0/Z^{0.5})^n,$$

wherein A is the molecular weight, rho is the density (in g/cm$^3$), Z is the atomic number and n is given by $n=1.2/(1-0.29\log_{10}Z)$, $E_0$ is 7.5 (kVolt) and R is the penetration depth in nm.

| Material | penetration depth R (in $\mu$m) | specific mass rho |
|---|---|---|
| Al2O3 | 1.12 | 3.0 |
| Eu2O3 | 0.24 | 7.4 |
| In2O3 | 0.30 | 7.2 |
| PbO2 | 0.29 | 9.4 |
| Sb2O3 | 0.38 | 5.7 |
| SiO2 | 1.32 | 2.2 |
| SnO2 | 0.44 | 7.0 |
| Ta2O5 | 0.17 | 8.2 |
| TiO2 | 0.82 | 3.8 |
| WO3 | 0.37 | 7.2 |
| ZnO | 0.60 | 5.2 |
| ZnS | 0.77 | 4.0 |
| Y2O3 | 0.48 | 5.0 |
| ZrO2 | 0.94 | 3.3 |

Figure 2C:
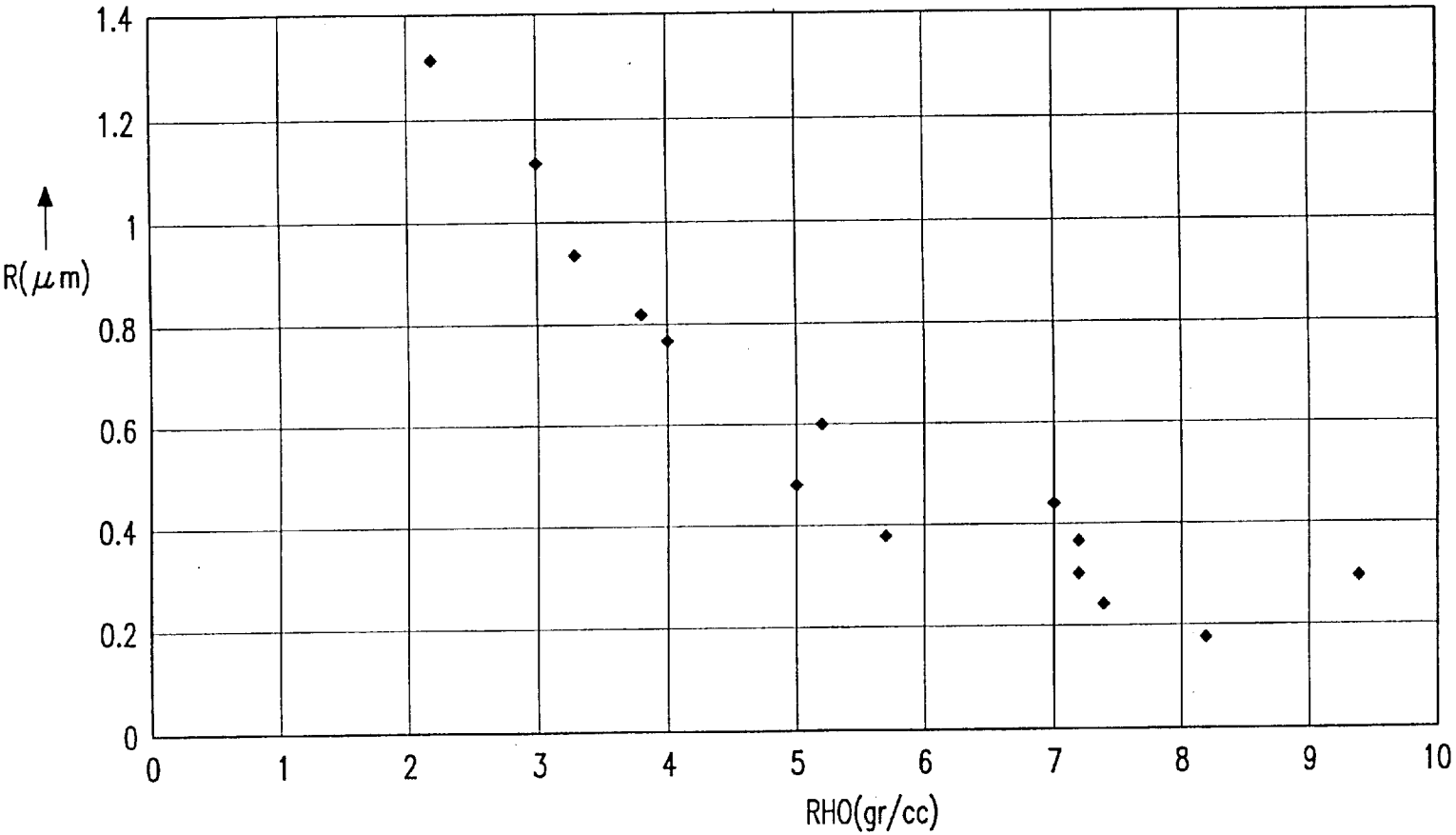
FIG. 2C shows the depth of penetration R (in $\mu$m) as a function of the specific mass Ro (in gr/cc).

FIG. 2C shows the depth of penetration R (in $\mu$m) as a function of the specific mass Rho (in gr/cc).

Preferably, inorganic materials are used, because organic materials generally exhibit much larger penetration depths than inorganic materials. The "stopping power" of organic materials is generally smaller than that of inorganic materials. Organic materials are predominantly composed of C, O, H and N (elements having a low Z number) and generally have a low density (of the order of 1 g/cm$^3$). The penetration depth is approximately 5 to 10 times that of inorganic materials. In the invention, the thickness of the inorganic intermediate layer is preferably greater than the penetration depth R. Almost all electrons passed by the phosphor layer are stopped by such layers before they are incident on the color filter layer. The invention is not limited to layers of such a thickness. Thinner layers can also be used in embodiments in accordance with the invention. Layers having a thickness from 0.1R to 1R may not stop all electrons but they do stop a substantial number of electrons. The intermediate layer may be composed of various sub-layers. In preferred embodiments which can be readily manufactured, however, the intermediate layer is a single layer.

The invention is based on the recognition that electrons passed by the phosphor cause an ageing phenomenon in the filter layer (filter layers). This has two adverse effects. First, the absorption spectrum of a color filter layer changes in the course of time and hence the color reproduction changes too, and, second, a large number of pigments (predominantly organic pigments) cannot be used in the color filter layers. An inorganic intermediate layer for stopping the electrons precludes and/or reduces these disadvantages, and enables pigments which are unstable during electron bombardment to be used.

An example of a method of applying an intermediate layer between a color filter layer and the phosphor pattern is schematically illustrated in FIGS. 3A through 3H.

Figure 3A:
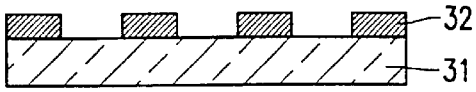
FIGS. 3A through 3H illustrate a method of manufacturing a display device in accordance with the invention.

A. Application of a black matrix 32 to a substrate 31; this can be carried out by means of known methods. (FIG. 3A). B.

Figure 3B:
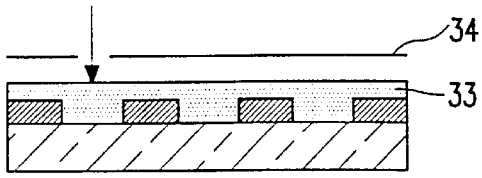
Figure 3C:
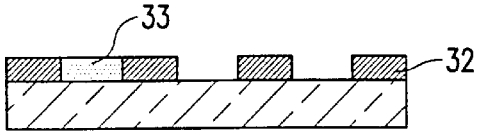

Application of a photo-sensitive layer with a red dye 33 to the substrate, exposure of the layer 33 through a mask 34 (FIG. 3B).

C. Removal of the unexposed photo-sensitive layer (FIG. 3C) to form a color filter.

Figure 3D:
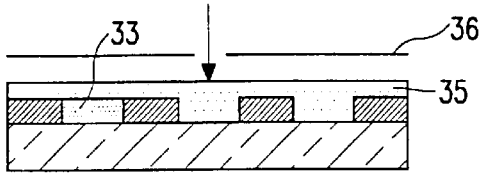
Figure 3E:
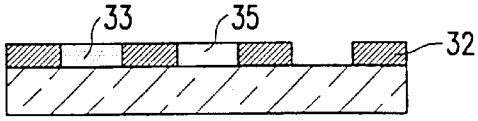

D. Application of a photo-sensitive layer 35 with a blue dye 33 to the substrate, exposure of the layer 35 through a mask 36 (FIG. 3D).

E. Removal of the unexposed photo-sensitive layer (FIG. 3E) to form a blue dye layer.

F. Application of a TEOS (tetraethyl orthosilicate) or a TEOTI (tetraethyl orthotitanate) sol-gel solution to the color filter layers by means of spin coating. Curing the sol-gel solution to form an $SiO_2$ or $TiO_2$ transparent intermediate layer 37. Alternatively, for example a colloidal $SiO_2$ solution can be applied instead of a TEOS solution. Preferably, the intermediate layer is obtained from a colloidal solution. This has the advantage, relative to an intermediate layer obtained from a sol-gel solution, that after the developing operation less phosphor haze occurs. A colloidal solution (for example an aqueous solution) is applied by spin coating or flow coating and dried by exposure to IR lamps.

A few examples of usable colloidal dispersions are silica dispersions (such as Ludox and Syton by Dupont, Levasil by Bayer, Snowtex by Nissan, Nyasol by Akzo and Aerosil by Degusa). Dispersions of SnO, ATO (Antimony Tin Oxide), ITO and $Ta_2O_5$ may alternatively be used. Preferably, the average particle size ranges between 5 and 150 micrometers. A conductive intermediate layer (for example an intermediate layer containing ITO, ATOP or indium oxide) has the advantage that charging of the color filter layers is reduced.

Figure 3F:
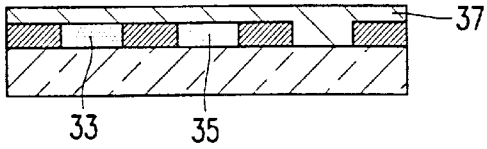

G. Application of a photosuspension 39 with blue-luminescent phosphors. Exposure of the photosuspension 39 through a mask 38 (FIG. 3F). Removal of unexposed parts.

Figure 3G:
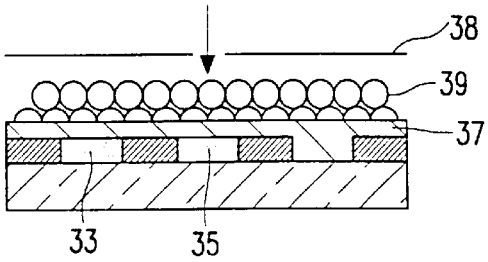
Figure 3H:
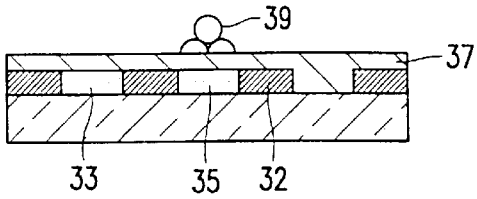

H. The final result. The intermediate layer 37 extends between the phosphor element 39 and the color filter 35. Further phosphors (red and green) can be provided in a customary manner (as schematically shown in FIG. 3G). The order in which the phosphors are applied is not of importance to the invention.

In operation, the blue phosphors (just like the green and red phosphors) are excited by high-energy electrons. The phosphors allow passage of a part of these electrons, yet the average energy content of these electrons is lower (of the order of 7.5 kVolts) and, in accordance with the invention, they are at least partly stopped by the intermediate layer before they can reach the color filter layer (or layers). The inventors have recognized that the provision of the intermediate layer (phosphor haze) also leads to a reduction of phosphor haze. The intermediate layer 37 precludes or reduces the risk that blue phosphor particles (25B) adhere to the red color filter layer 35 or to the edges of the apertures in the black matrix.

By virtue thereof, phosphor haze is reduced or precluded. This advantage can be achieved without the necessity of preserving the intermediate layer during further manufacturing steps.

The intermediate layer can be removed in a further process step, for example by using an intermediate layer which decomposes when it is exposed to a temperature below the maximum temperature to which the color display device is exposed in the manufacturing process.

Figure 4A:
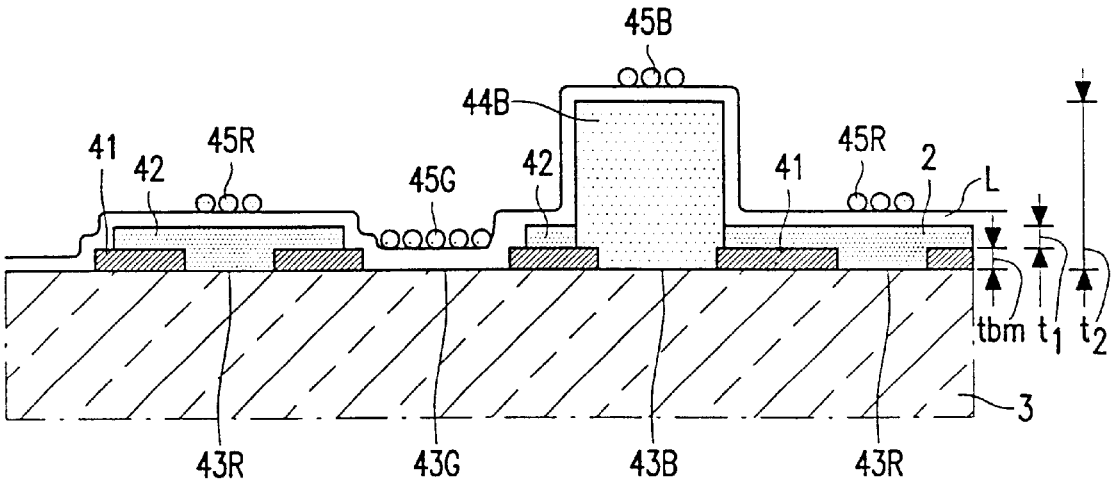
FIG. 4A is a cross-sectional view of a display window for a display device in accordance with the invention comprising color filter layers and an inorganic intermediate layer.
Figure 4B:
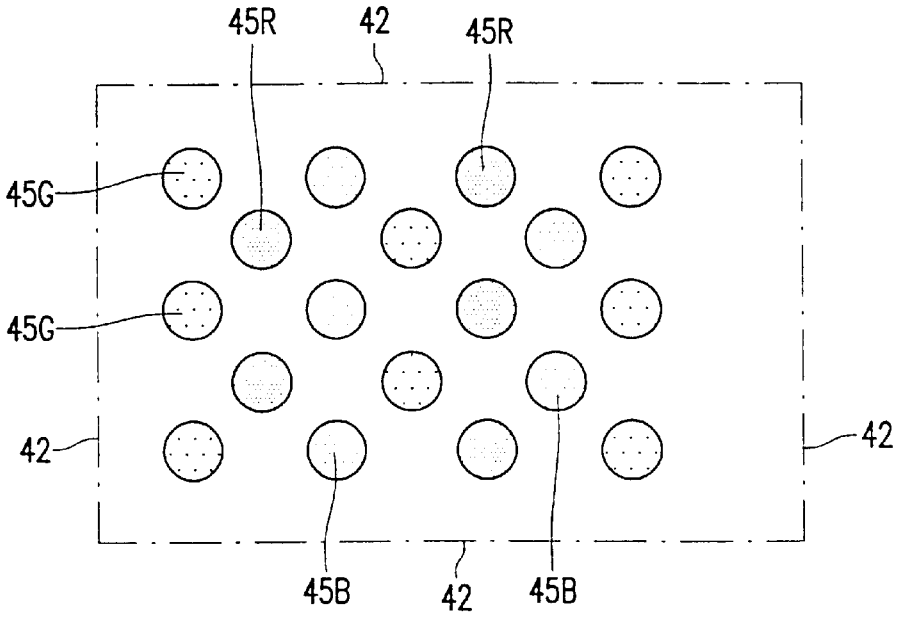
FIG. 4B is a view of a display window for a display tube in accordance with the invention.

FIG. 4A is a cross-sectional view of a display window of a color cathode ray tube in accordance with the invention. FIG. 4B is a plan view of (the phosphor elements on) the display window shown in FIG. 4A. The inner surface of the display window is provided with a black matrix 41. Color filter layer 42 extends over apertures 43R for phosphor elements R (red) and over the black matrix 41, with the exception of apertures 43B, 43G for the phosphor elements B (blue) and G (green), respectively. Color-filter-layer regions 44B are arranged in the apertures 43B. The color-filter-layer regions 44B project above the black matrix. In this example, the thickness $t_2$ of the color filter layer 44B is 1.5–5 $\mu$m. The thickness $t_1$ is approximately 0.5–0.7 micrometer. An intermediate layer L is applied to the color filter layers. Phosphors 45R, 45G and 45B are provided above the apertures 43R, 43G and 43B, and the color filter layers, if any, extend between the phosphors and the substrate.

Intermediate layers comprising materials having a relatively low refractive index ($n<1.8$) and, in particular, $SiO_2$ layers bring about an additional advantage. The intensity of the light emitted by the blue phosphor increases due to the presence of the intermediate layer. An intermediate layer of $SiO_2$ between the blue color filter (in this example of cobalt aluminate) and the blue phosphor pattern, said intermediate layer having a thickness of approximately 0.2–0.5 micrometer, increases the luminous efficiency (relative to a situation in which there is no intermediate layer between the color filter and the phosphor pattern) by approximately 20%.

The color display device in accordance with the invention can be briefly described as follows:

A transparent inorganic intermediate layer extends between a color filter layer and a phosphor layer. Said intermediate layer stops electrons before they can penetrate the color filter layer. Ageing phenomena which adversely affect the effectiveness of the color filter layer are thus precluded. It is alternatively possible to use hitherto useless pigments, in particular pigments which are unstable in the case of an electron bombardment in the color filter layer (or layers). By virtue thereof, the effectiveness of the color filter layer has been increased.

The method is characterized in that an intermediate layer is provided between the color filter layers and the phosphor pattern. By virtue thereof, phosphor haze is reduced or precluded.

Said intermediate layer may be permanent or decompose during further process steps.

It will be obvious that the invention is not limited to the above examples. For example, FIG. 1 shows a conventional type of color cathode ray tube. Within the scope of the invention, the term "color display device" should be interpreted in a broad sense as any display device comprising, on a substrate, a pattern of phosphors incorporating three luminescent phosphors. Color display devices include all kinds of flat display devices, such as plasma displays.

What is claimed is:

1. A color cathode ray tube comprising a means for generating electrons and a substrate provided with a phosphor pattern, a color filter layer extending between the phosphor pattern and the substrate, characterized in that a transparent intermediate layer extends between and contacts the color filter layer and the phosphor pattern, wherein the intermediate layer comprises a material having a sufficient thickness to prevent electrons having a kinetic energy greater than 7.5 kVolts from passing therethrough to the color filter layer.

2. A color cathode ray tube as claimed in claim 1, characterized in that the intermediate layer comprises an inorganic material.

3. A color cathode ray tube as claimed in claim 2, characterized in that the specific mass of the material of the inorganic layer is above 3 g/cm$^3$.

4. A color cathode ray tube as claimed in claim 1, characterized in that the thickness of the intermediate layer is less than 1 micrometer.

5. A color cathode ray tube as claimed in claim 1, characterized in that the color filter comprises a pigment which is unstable when it is exposed to an electron bombardment.

6. A color cathode ray tube as claimed in claim 1, characterized in that the material of the intermediate layer has an optical refractive index below 1.8.

7. A color cathode ray tube as claimed in claim 7, characterized in that the intermediate layer mainly comprises silicon oxide.

8. A color cathode ray tube as comprising:

a means for generating electrons;

a substrate provided with a phosphor pattern;

a color filter layer extending between the phosphor pattern and the substrate; and a transparent intermediate layer extending between and contacting the color filter layer and the phosphor pattern, wherein the intermediate layer has a layer thickness d (in nm) which exceeds 25(A/rho)(EO/Z0.5)n, wherein A is the molecular weight, rho is the density (in $g/cm^3$), $E_0$ is 7.5(kVolt), Z is the atomic number of the material of the intermediate layer, and n is given by $n=1.2/(1-0.29 \log_{10}Z)$.

9. The color cathode ray tube of claim 8, wherein the intermediate layer comprises an inorganic material.

10. The color cathode ray tube of claim 9, wherein the specific mass of the material of the inorganic layer is above 3 $g/cm^3$.

11. The color cathode ray tube of claim 8, wherein a thickness of the intermediate layer is less than 1 micrometer.

12. The color cathode ray tube of claim 8, wherein the color filter comprises a pigment which is unstable when it is exposed to an electron bombardment.

13. The color cathode ray tube of claim 8, wherein the material of the intermediate layer has an optical refractive index below 1.8.

14. The color cathode ray tube of claim 13, wherein the intermediate layer mainly comprises silicon oxide.

* * * * *